US010257893B2

(12) United States Patent
Rafik et al.

(10) Patent No.: US 10,257,893 B2
(45) Date of Patent: Apr. 9, 2019

(54) ADAPTIVE LUMINOUS INTENSITY DISTRIBUTION OF LED LUMINAIRES

(71) Applicant: SIGNIFY HOLDING B.V., Eindhoven (NL)

(72) Inventors: Ahamed Rafik, Coimbatore (IN); Goutam Maji, Bangalore (IN)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/735,325

(22) PCT Filed: Jun. 9, 2016

(86) PCT No.: PCT/EP2016/063090
§ 371 (c)(1),
(2) Date: Dec. 11, 2017

(87) PCT Pub. No.: WO2016/198489
PCT Pub. Date: Dec. 15, 2016

(65) Prior Publication Data

US 2018/0177006 A1 Jun. 21, 2018

(30) Foreign Application Priority Data

Jun. 9, 2015 (EP) ..... 15171222

(51) Int. Cl.
*H05B 33/08* (2006.01)

(52) U.S. Cl.
CPC ..... *H05B 33/083* (2013.01); *H05B 33/0803* (2013.01); *H05B 33/0845* (2013.01)

(58) Field of Classification Search
CPC ..... H05B 33/083; H05B 33/086; H05B 33/0803; H05B 33/0842; H05B 33/0845;
(Continued)

(56) References Cited

U.S. PATENT DOCUMENTS 7,746,007 B2 * 6/2010 Cauffield ..... H05B 33/086 315/307
8,314,566 B2 * 11/2012 Steele ..... F21V 23/02 315/185 R (Continued)

FOREIGN PATENT DOCUMENTS

WO 2013121342 A2 8/2013
WO 2013158955 A1 10/2013

*Primary Examiner* — Haissa Philogene
(74) *Attorney, Agent, or Firm* — Akarsh P. Belagodu

(57) ABSTRACT

A luminaire that adjusts a certain set of light sources according to the installation location of said luminaire with respect to an external structure. A luminaire with a light emitting surface comprising a LED driver (30); an array of light sources, the luminaire further comprising: a light output tuning unit, connected to a certain set of light sources within the array and being able to tune an light output of said certain set of light sources; an interface adapted to be operated during an installation/commissioning of the luminaire, adapted for receiving configuration information which is dimming information; and a control unit, for controlling the tuning unit according to the received configuration information; wherein the light emitting surface is a planar surface and said certain set of light sources is on at least one edge of the planar surface and wherein said array of light sources is connected to the LED driver (30) and the light output tuning unit comprises a dimming circuit including at least one shunt switch adapted to shunt said certain set of light sources off from or on to the LED driver (30).

12 Claims, 8 Drawing Sheets

(58) Field of Classification Search
CPC ..... H05B 33/0851; H05B 37/02; H05B 37/0227; H05B 33/12
See application file for complete search history.

(56) References Cited

U.S. PATENT DOCUMENTS

| | | | | |
|---|---|---|---|---|
| 8,338,849 | B2 * | 12/2012 | Tischler | H01L 27/156 257/98 |
| 9,062,854 | B2 * | 6/2015 | Livesay | H01L 33/642 |
| 9,465,138 | B2 * | 10/2016 | Vissenberg | H05B 33/0851 |
| 2009/0134806 | A1 | 5/2009 | Cauffield | |
| 2011/0019031 | A1 | 1/2011 | Tanigawa et al. | |
| 2011/0074313 | A1 | 3/2011 | Gordin | |
| 2014/0042915 | A1 | 2/2014 | Ono et al. | |
| 2014/0312779 | A1 | 10/2014 | Vissenberg et al. | |
| 2014/0320023 | A1 | 10/2014 | Cannon et al. | |
| 2014/0339985 | A1 | 11/2014 | Engelen et al. | |
| 2016/0131331 | A1 * | 5/2016 | Parker | G02B 6/0001 362/311.02 |

* cited by examiner

ADAPTIVE LUMINOUS INTENSITY DISTRIBUTION OF LED LUMINAIRES

CROSS-REFERENCE TO PRIOR APPLICATIONS

This application is the U.S. National Phase application under 35 U.S.C. § 371 of International Application No. PCT/EP2016/063090, filed on Jun. 9, 2016, which claims the benefit of European Patent Application No. 15171222.1, filed on Jun. 9, 2015. These applications are hereby incorporated by reference herein.

FIELD OF THE INVENTION

This invention relates to LED luminaires.

BACKGROUND OF THE INVENTION

Power LED is a point source of light. A LED luminaire consists of a number of power LEDs connected in series or parallel or a combination of the two. The luminaires are designed to provide the right amount of light to the target area. The light level is adjusted by dimming to meet the user specific light requirement.

A typical luminaire provides light equally in all directions. The evenly distributed light is not completely utilized by the target area. For example, if a down light is mounted near a wall, as some amount of light falls on walls, not on the floor below the down light. In case of indoor application, light gets wasted by non-reflecting walls whereas in outdoor application lights get wasted in the surroundings. FIG. 1 shows an example of tunnel lighting: some light emitted from the luminaire falls to the wall and the ceiling, such as shown by the circular sectors on the wall and the ceiling. If the wall is far away from the target area, light gets wasted even if the wall is reflective. This light loss causes wastage of energy.

SUMMARY OF THE INVENTION

US20140312779A1 discloses a luminaire with different light sources configured to emit light beams with different and controllable beam patterns. The structure of the luminaire in this prior art is relatively complex. Further it uses a sensor to sense the external object and adjust the light beams dynamically, which further increases its complexity.

It would be advantageous to configure a luminaire to tune its output according to an external structure that is neighboring to said luminaire. More specifically, such configuration had better to be done when the luminaire is installed or commissioned before it is powered on and used. Most importantly, the luminaire needs to be quite simple and low cost for allowing the tuning of the light beams.

An idea of embodiments of the invention is adaptively controlling the LED driver, in such a way that LED strings that are closer to the wall will be dimmed, whereas other strings are not. If a portion of the LEDs of a luminaire whose light output is not reaching the target area is dimmed, then a considerable reduction in energy consumption is achieved. Therefore, the LED luminaire can be made configurable, during installation, to dim certain portion(s) of the LED luminaire, based on its position (e.g. near to the wall).

In order to provide this tuning in a simple way, a basic idea of the invention is that the dimming information is provided only at installation or commissioning stage thus does not involve dynamic/real time sensing; further shunt switches are used to shunt some LEDs on to/off from the driver, avoiding complex dimming circuit.

To better address this concern, one aspect of the invention proposes a luminaire with a light emitting surface comprising a LED driver; an array of light sources, the luminaire further comprising: a light output tuning unit, connected to a certain set of light sources within the array and being able to tune an light output of said certain set of light sources; an interface adapted to be operated during an installation/commissioning of the luminaire, adapted for receiving configuration information which is dimming information; and a control unit, for controlling the tuning unit according to the received configuration information; wherein the light emitting surface is a planar surface, said certain set of light sources is on at least one edge of the planar surface and wherein said array of light sources being in series with the LED driver and wherein said array of light sources is connected to the LED driver and the light output tuning unit comprises a dimming circuit adapted to dim said certain set of light sources, said dimming circuit including at least one shunt switch adapted to shunt said certain set of light sources off from or on to the LED driver.

In this aspect, a simple and low cost solution is provided that allows tuning the light emitting at the edge of the luminaire. The certain set of light sources can be dimmed such that power is saved and light wastage where not required is avoided. In many scenarios such as down light or tunnel light, the external structure of untargeted area is close to the edge of the luminaire. Thus the light source at the edge of the luminaire can be dimmed. The configuration happens only in installation or commissioning phase thus is static and low cost. Further, using the shunt switch that selectively switch on/off the light sources at the edge is also quite low cost.

In a preferred embodiment, said array of light sources is placed on a single LED board and adapted to form a rectangular array, and said certain set of light sources are on at least one edge of the rectangular array. This embodiment overcomes the complexity in the prior art that the different LEDs are carried by separate boards and separate power connections.

In a preferred embodiment, said array of light sources is connected in series with the single LED driver, and the shunt switch is connected in parallel with said certain set of light sources and adapted to bypass or not bypass said certain set of light sources from the driver. This embodiment further allows a simple driving for all light source, and allows the dimming of some LEDs without causing the disturbance of the LED driver and the other LEDs.

Preferably, said certain set of light sources are at two connecting edges of the rectangular array, the dimming circuit includes two shunt switches which are also placed on the single LED board, wherein one of the two shunt switch is in parallel with said certain set of light sources and the other one of the two shunt switches is in parallel with a subset of said certain set of light sources that are placed in one of the two connecting edges.

Said dimming information is relevant to an installation location of said luminaire with respect to an external structure that is neighboring to said certain set of light sources. An installation location of said luminaire with respect to an external structure is taken into consideration for tuning a certain set of light sources, and flexibility can be achieved. Further it is one time setting during installation or commissioning, and the configuration is static, hence low cost.

In a further embodiment, said installation location of said luminaire comprises that said planar light emitting surface is neighboring to an angled plane with respect to said planar light emitting surface, and said control unit is adapted to dim said certain set of light sources that is neighboring to said angled plane. In this embodiment, light sources near the angled plane can be dimmed to reduce light on that angled plane.

More specifically, the luminaire can be mounted on the ceiling near the wall wherein the wall is a vertical plane with respect to the downward light emitting plane. The light source near the wall can be dimmed to reduce light on the wall.

In a more specific implementation, the luminaire can be mounted on the corner of the ceiling, also near the wall corner. And said certain set is at two connecting edges of the rectangular array, and said location of said luminaire comprises that said certain set of light sources is neighboring to a corner of the ceiling. In this implementation, a corner of the luminaire can be dimmed to reduce light on the wall corner and more energy can be saved.

In an alternative embodiment, the luminaire is adapted to be placed at an intersection of a wall and a ceiling, said planar light emitting surface is adapted to face the space defined by said wall and said ceiling, and said location of said luminaire comprises that said certain set of light sources is neighboring to said wall and said ceiling. One example of this embodiment is tunnel light whose light emitting plane is tilted to cover the tunnel space. The embodiment reduces undesired light on the wall and ceiling.

In order to provide dimmed light source, many solutions can be used.

In one solution, at the edge said certain set of light sources are placed in an interlacing manner with respect to light sources that are not dimmed by said dimming circuit. Thus the overall output at the edge can be dimmed. In a more specific embodiment, the dimming circuit is adapted to turn off said certain set of light sources, while the undimmed light sources provide an overall low output at the edge. In this embodiment, the shunt switch can be manual switch like dip-switch.

In another solution, at the edge said certain set of light sources are placed in a continuous manner, and the dimming circuit is adapted to turn on and turn off said certain set in a certain duty. This is a normal PWM dimming solution wherein the output can be controlled more flexibly via the certain duty. In this embodiment, the shunt switch can be high frequency switch like semi-conductor switch.

In a more flexible embodiment, how much the light source is dimmed can be selected from multiple levels. The interface is adapted for receiving a dimming level among multiple levels that is relevant to a distance of said luminaire with respect to said external structures, and the control unit is further adapted to control the dimming circuit according to said dimming level.

In an embodiment, said light output tuning unit is adapted to tune the color of the output light of said certain set of light source, said configuration information comprises color information. This embodiment provides a more flexible solution.

In an embodiment, said dimming circuit is adapted to one time set said dimming information for said certain set of light sources during installation or commissioning after said dimming information has been received during the installation or commissioning and fix said dimming information during normal operation of the luminaire. Since the mount location of the luminaire is static after the installation, this embodiment provides a one-time setting for the normal operation.

These and other aspects of the invention will be apparent from and elucidated with reference to the embodiment(s) described hereinafter.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a luminaire with a light emitting surface comprising an array of light sources, the luminaire further comprising:

- a light output tuning unit, connected to a certain set of light sources within the array and being able to tune a light output of said certain set of light sources;
- an interface 32 adapted to be operated during an installation/commissioning of the luminaire, adapted for receiving configuration information which is relevant with an installation location of said luminaire with respect to an external structure that is neighboring to said certain set of light sources; and
- a control unit 34, for controlling the tuning unit according to the received configuration information.

The below description uses a down light to be mounted on a ceiling as an example to elucidate the invention. And using wall as the external structure wherein the light from the luminaire is not preferred to reach the wall.

A typical down light has a light emitting surface of a planar surface, and an array of light sources comprises a rectangular array on the planar surface, said certain set of light sources are at the edge of the rectangular array.

Figure 1:
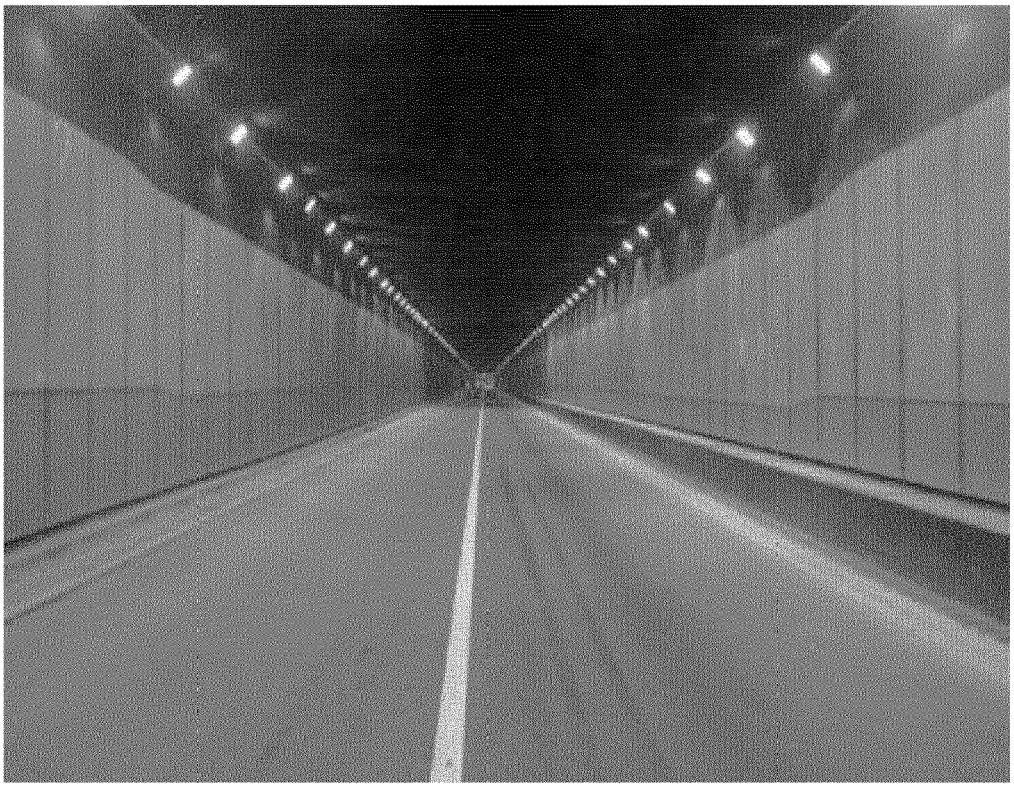
FIG. 1 shows an example of tunnel lighting in which undesired light are emitted on the wall and ceiling of the tunnel.
Figure 2:
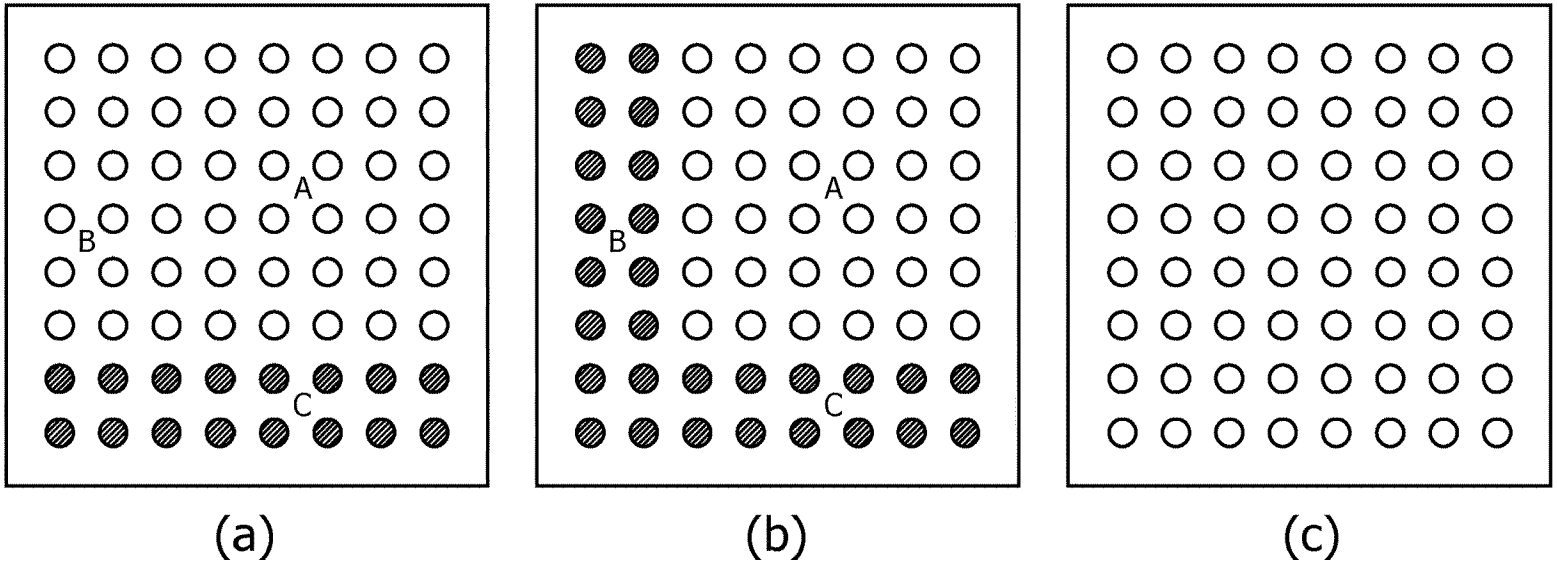
FIG. 2 shows three configurations of the luminaire according to an embodiment of the invention.

As shown in FIG. 2, (a) shows a luminaire that is preferred to be placed with its down edge closest to the wall. (b) shows a luminaire that is preferred to be placed with its left and down edges closest to the wall, namely it is placed in the corner. And (c) shows a luminaire that is preferred to be placed away from the wall.

The shaded light sources in FIGS. 2 (*a*) and (*b*) stand for the light source are dimmed down. The LEDs in the left edge, in the down edge and rest are respectively referred as B, C and A. In this case, the dimmed light source would not provide too much usefulness light to the wall thus energy is saved.

In a more specific embodiment, all the light source at the edge is dimmed down, such as by a 50%. The certain set of light sources are placed in a continuous manner. And the dimming circuit is adapted to turn on and turn off said certain set in a certain duty, such a 50% duty cycle.

Figure 3:
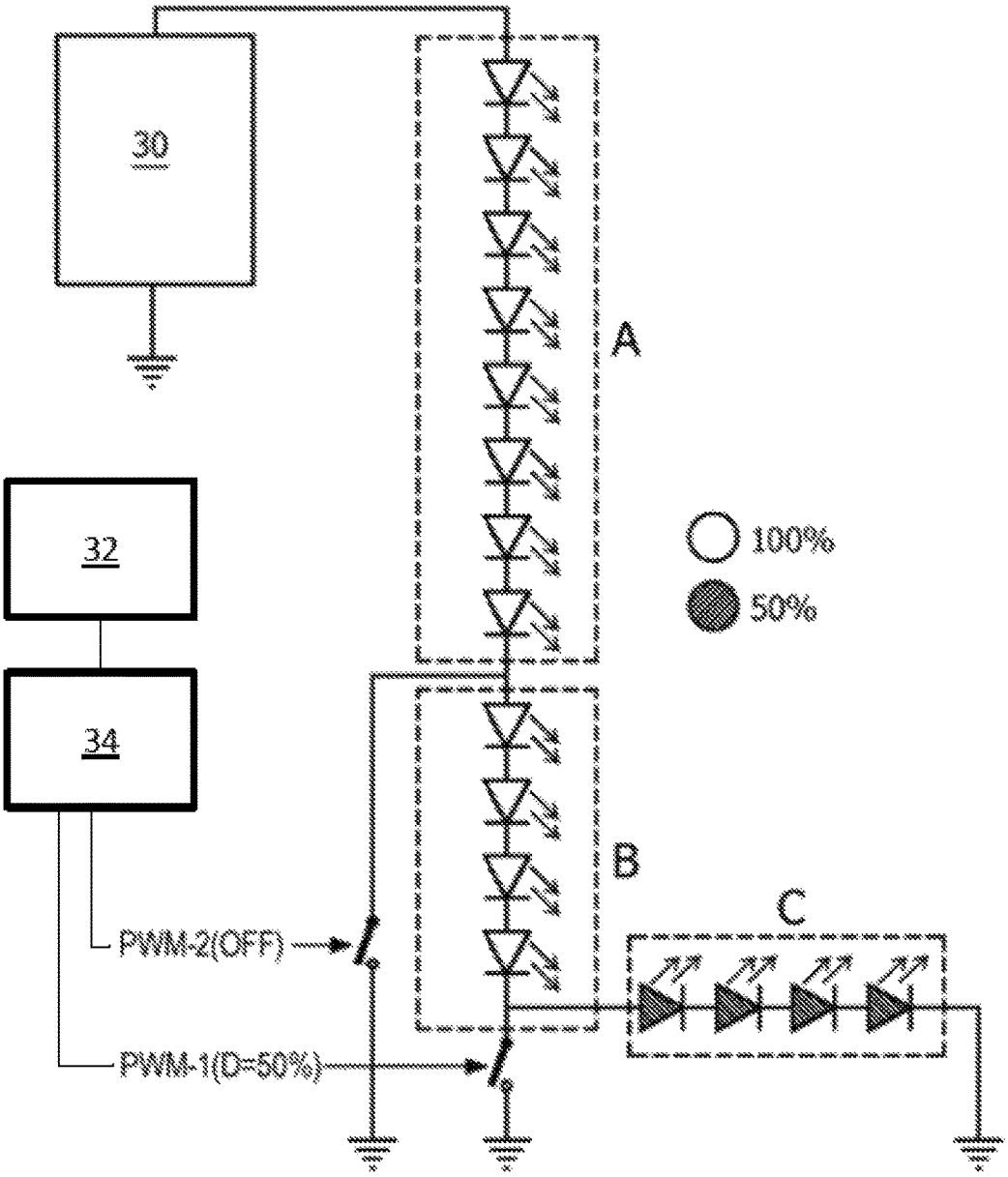
FIG. 3 shows a circuit scenario to realize configuration (a) of FIG. 3.

FIG. 3 shows the specific circuit to realize the configuration of FIG. 2 (*a*). The luminaire comprises a LED driver 30, wherein said certain set of light sources B and C and light sources A that are not dimmed by said dimming circuit are series connected with said LED driver, and said dimming circuit comprises a first shunt switch in parallel with said certain set B of light sources, and second shunt switch in parallel with said certain set C of light sources.

For FIG. 2 (*a*), set C of light sources are dimmed while set A and set B are not dimmed. As shown in FIG. 3, the first shunt switch in parallel with said certain set B of light sources is off, and the second shunt switch in parallel with said certain set C of light sources is turned on/off alternatively in a 50% duty cycle such that the edge where the certain set C is placed is dimmed at a 50% dimming level.

Figure 4:
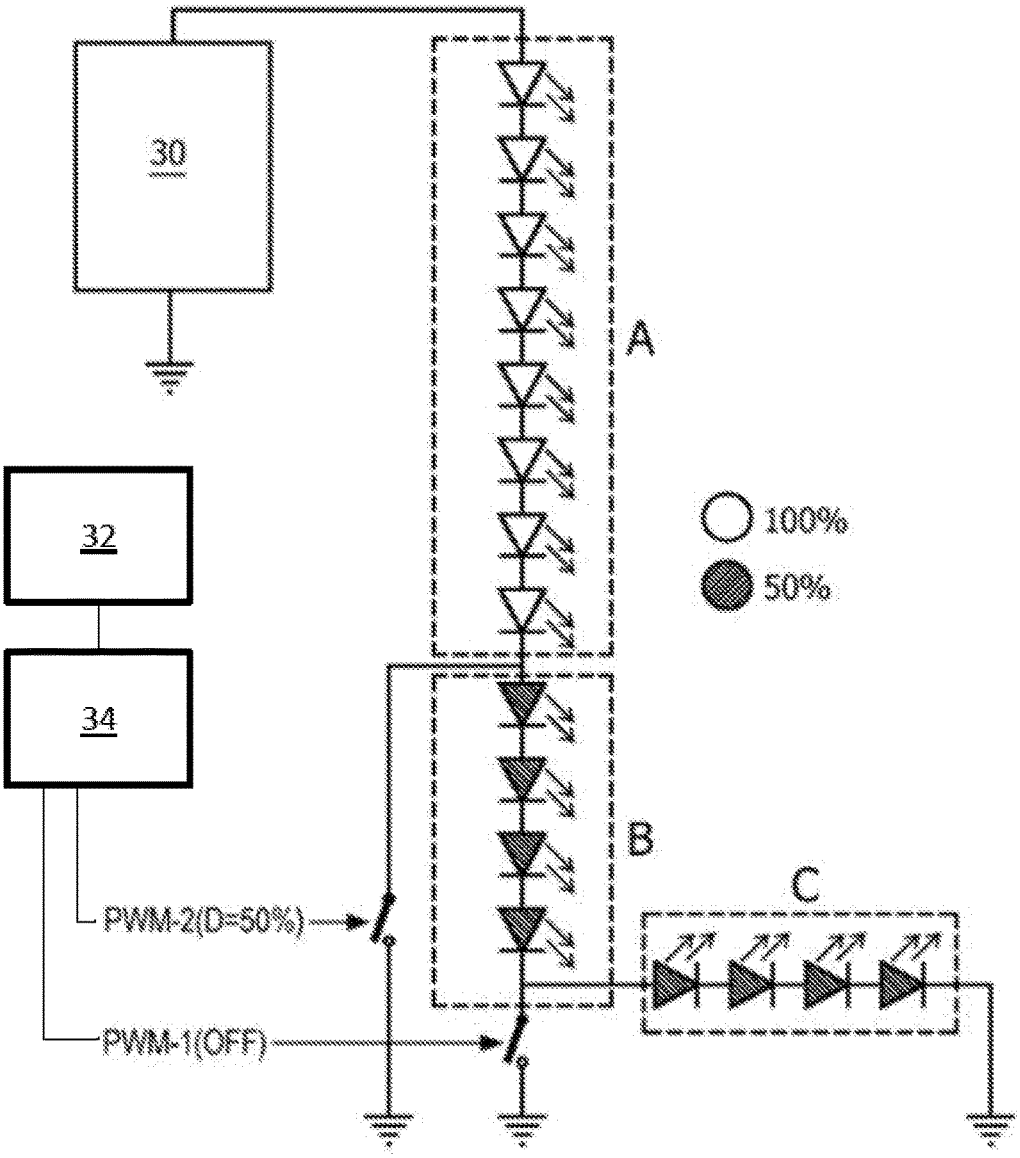
FIG. 4 shows a circuit scenario to realize configuration (b) of FIG. 3.

For FIG. 2 (*b*), sets C and B of light sources are dimmed while set A is not dimmed. As shown in FIG. 4, the second shunt switch in parallel with said certain set C of light sources is off, and the first shunt switch in parallel with said certain set B of light sources is turned on/off alternatively in a 50% duty cycle such that the edges/corner where the certain sets C and B are placed is dimmed at a 50% dimming level.

In a more sophisticated solution, the dimming level is selectable among multiple dimming levels according to a distance of said luminaire with respect to said external structures. For example, if the luminaire and the wall are closer with each other, the light sources can be more dimmed.

Another possible solution to achieve the brightness control of a particular edge is by turning "OFF" every alternate LEDs of at that edge. More specifically, at the edge said certain set of light sources are placed in an interlacing manner with respect to light sources that are not dimmed by said dimming circuit and the dimming circuit is adapted to turn off said certain set of light sources.

Figure 5:
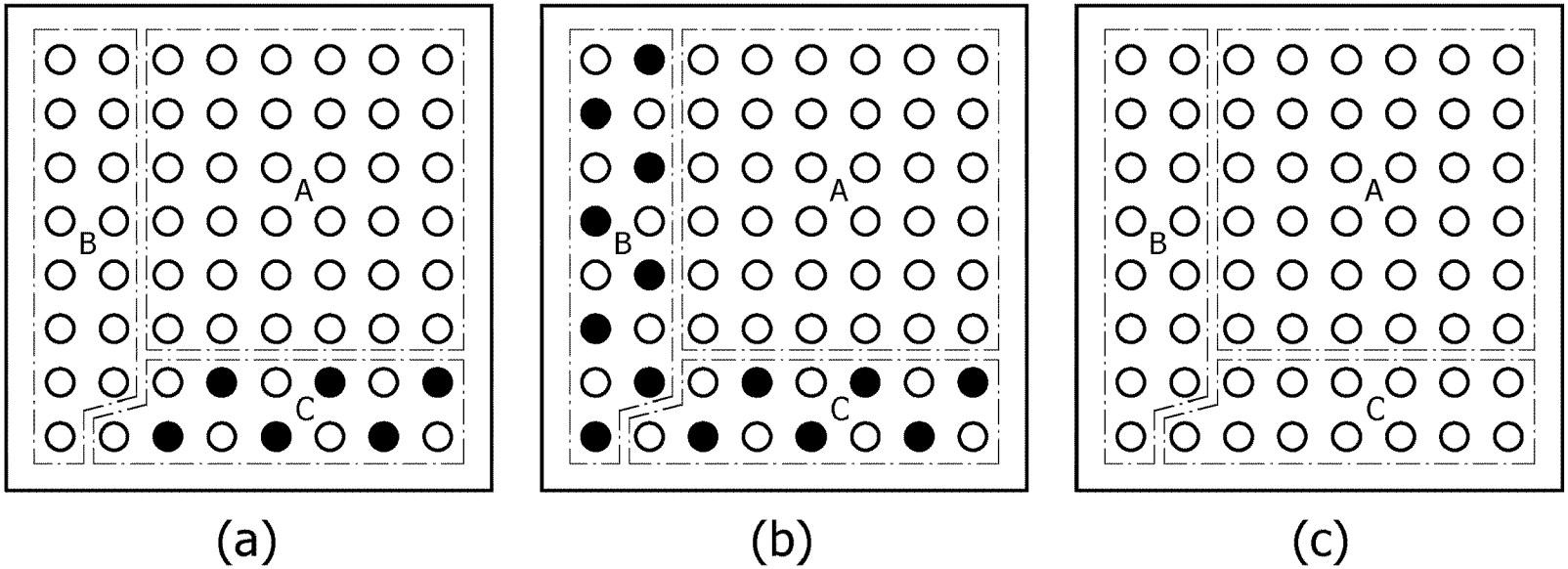
FIG. 5 shows another specific solution to realize the three configurations in FIG. 2.

This solution is schematically shown in FIG. 5. FIG. 5, (a) shows a luminaire that is preferred to be placed with its down edge closest to the wall. (b) shows a luminaire that is preferred to be placed with its left and down edges closest to the wall, namely it is placed in the corner. And (c) shows a luminaire that is preferred to be placed away from the wall.

The blacked light sources in FIGS. 5 (*a*) and (*b*) stand for the light source are turn off. The LEDs in the left edge, in the down edge and rest are respectively referred as B, C and A.

Figure 6:
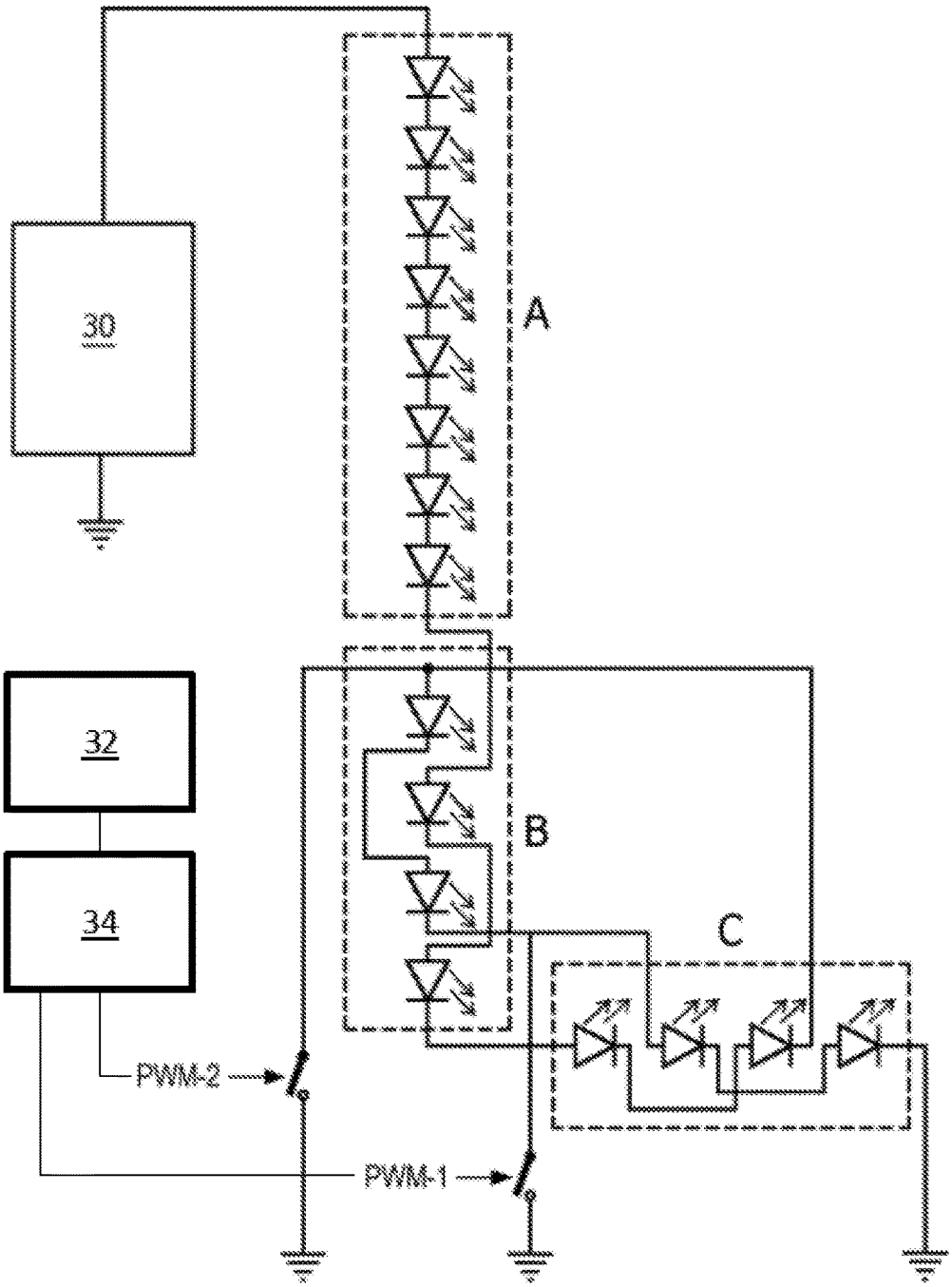
FIG. 6 shows a specific circuit to realize configuration (a) of FIG. 5.

FIG. 6 shows the specific circuit to realize the configuration of FIG. 5. For B and C segment, said certain set of light sources are placed in an interlacing manner with respect to light sources that are not dimmed by said dimming circuit. And the luminaire comprises a driver, wherein said certain set of light source and light sources that are not dimmed by said dimming circuit are series connected with said driver, and said dimming circuit comprise a third shunt switch in parallel with the certain set of light source in segment C and a fourth shunt switch in parallel with the certain set of light source in segment B.

Figure 7:
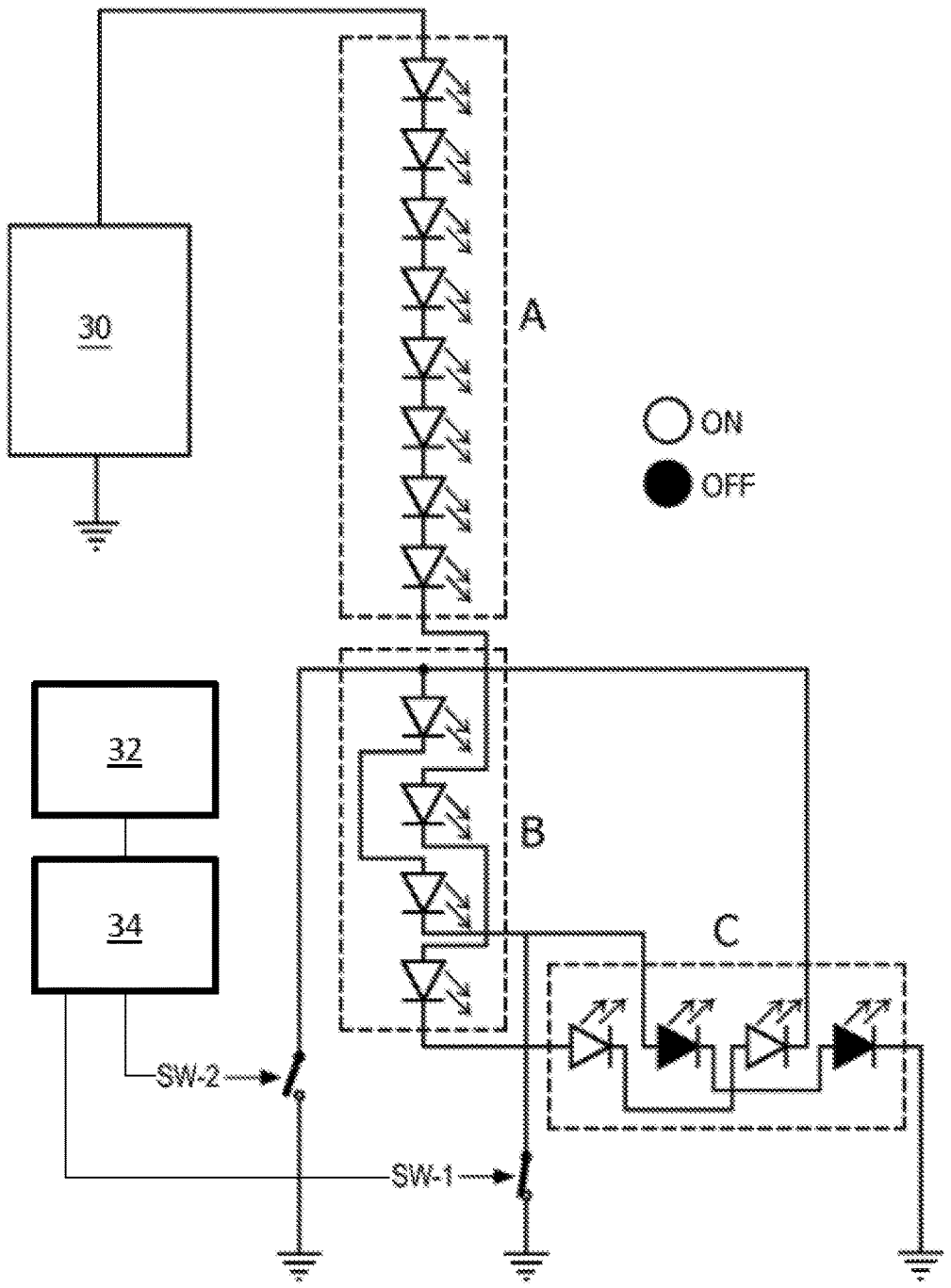
FIG. 7 shows an operation state of the circuit in FIG. 6 to realize configuration (a) of FIG. 5.

FIG. 7 shows the scenario to realize configuration (a) of FIG. 5. The third switch is on to shunt the certain light source in segment C, which certain light source is half of the LED in segment C at the down edge in FIG. 5.

Figure 8:
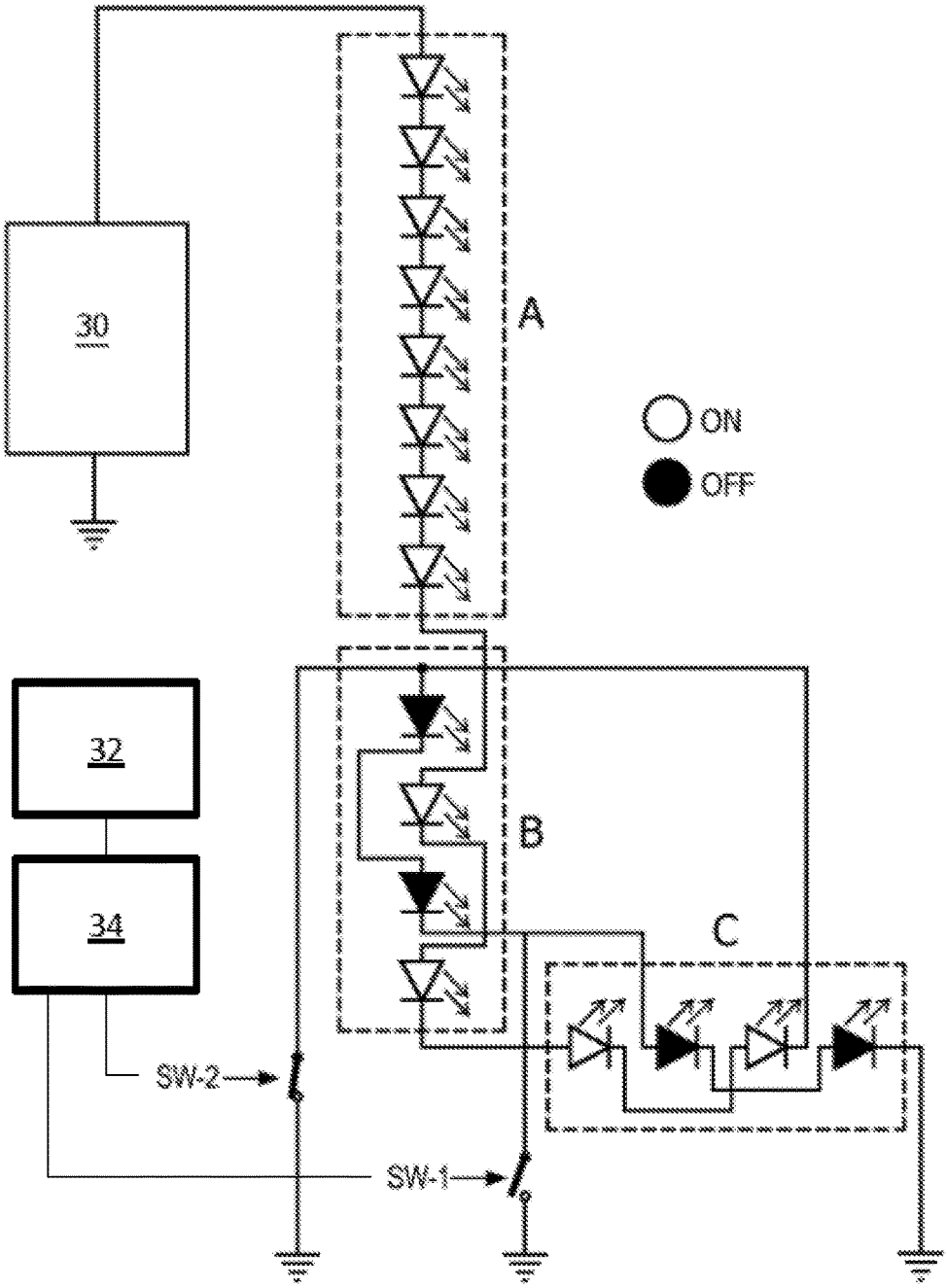
FIG. 8 shows an operation state of the circuit in FIG. 6 to realize configuration (b) of FIG. 5.

FIG. 8 shows the scenario to realize configuration (b) of FIG. 5. The fourth switch is on to shunt the certain light source in segments C and B, which certain light source is half of the LED in segment C at the down edge and half of the LED in segment B at the left edge as shown in FIG. 5.

The interface 32 of the luminaire is adapted to be operated during installation/commissioning of the luminaire. As soon as the operator knows that the luminaire is mounted near the wall or near the corner, the operator would input the configuration information into the luminaire to dim down corresponding set of light sources.

The interface 32 could be implemented in hardware or software. For example, one or more dip-switches can be used for receiving the configuration information. In the embodiment as shown in FIGS. 3 and 4, the state of the dip-switch can be read and used for generated corresponding PWM-1 or PWM-2. In the embodiments as shown in FIG. 6, the state of the dip-switch can be read and used for determining the state of the switches SW-1 and SW-2; alternatively, the dip-switch could be the switches SW-1 and SW-2 themselves.

While the invention has been illustrated and described in detail in the drawings and foregoing description, such illustration and description are to be considered illustrative or exemplary and not restrictive; the invention is not limited to the disclosed embodiments. For example, in the above embodiment, the wall or wall corner is the external structure that is neighboring to said certain set of light sources. In varied embodiment, the external structure is possible to be other objects such as pillar, or non-permanent structures.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

What is claimed is:

1. A luminaire with a light emitting surface comprising an array of light sources, the luminaire further comprising:

a LED driver, the array of light sources being connected in series with the LED driver;

a light output tuning unit connected to a certain set of light sources within the array and being able to tune a light output of said certain set of light sources;

an interface adapted to be operated during an installation or commissioning of the luminaire before normal operation of the luminaire, the interface adapted for receiving configuration information at least comprising dimming information; and a control unit, for fixing the tuning unit according to the received configuration information during normal operation of the luminaire;

wherein the light emitting surface is a planar surface forming said light emitting surface, said certain set of light sources is on at least one edge of the planar surface and wherein said array of light sources is rectangular and is connected to the LED driver and the light output tuning unit comprises a dimming circuit adapted to dim said certain set of light sources, said dimming circuit including at least one shunt switch adapted to shunt said certain set of light sources off from or on to the LED driver, wherein said certain set of light sources are at two connecting edges of the array, the dimming circuit includes two shunt switches, wherein one of the two shunt switches is in parallel with said certain set of light sources and adapted to bypass or not bypass said certain set of lights sources from the driver and the other one of the two shunt switches is in parallel with a subset of said certain set of light sources that are placed in one of the two connecting edges.

2. The luminaire according to claim 1, wherein said interface is further adapted for receiving a dimming level among multiple levels that is relevant to a distance of said luminaire with respect to external structures, and the control unit is further adapted to control the dimming circuit according to said dimming level.

3. The luminaire according to claim 1, wherein said light output tuning unit is adapted to tune the color of the output light of said certain set of light sources, said configuration information comprises color information.

4. The luminaire according to claim 1, wherein said certain set of light sources and other light sources are placed in an interlacing manner at the edge, and the shunt switch is adapted to shunt said certain set of light sources all the time in case at the edge said certain set of light sources and other light sources are placed in an interlacing manner.

5. The luminaire according to claim 1, wherein said shunt switch comprises a manual electric switch such as a dip-switch.

6. The luminaire according to claim 1, wherein said certain set of light sources are placed in a continuous manner at the edge, and the shunt switch is adapted to shunt and not shunt said certain set in a certain duty in case at the edge said certain set of light sources are placed in a continuous manner.

7. The luminaire according to claim 1, wherein said shunt switch comprises semi-conductor switch such as a transistor.

8. The luminaire according to claim 1, wherein said dimming circuit is adapted to:

one time set said dimming information for said certain set of light sources during installation or commissioning after said dimming information has been received during the installation or commissioning and fix said dimming information during normal operation of the luminaire.

9. The luminaire according to claim 1, wherein an installation location of said luminaire comprises that said planar light emitting surface is neighboring to an angled plane with respect to said planar light emitting surface, and said control unit is adapted to dim said certain set of light sources that is neighboring to said angled plane.

10. The luminaire according to claim 9, wherein said luminaire is a down-light adapted to be installed on a ceiling, said planar light emitting surface is adapted to face downward, and said installation location of said luminaire comprises that said certain set of light sources is neighboring to walls.

11. The luminaire according to claim 1, wherein an installation location of said luminaire comprises that said certain set of light sources is neighboring to a corner of a ceiling.

12. The luminaire according to claim 1, wherein said luminaire is adapted to be placed at an intersection of a wall and a ceiling, said planar light emitting surface is adapted to face a space defined by said wall and said ceiling, and said installation location of said luminaire comprises that said certain set of light sources is neighboring to said wall and said ceiling.

* * * * *